US005647830A

United States Patent [19]

Togao

[11] Patent Number: 5,647,830

[45] Date of Patent: Jul. 15, 1997

[54] HEALTH EQUIPMENT

[75] Inventor: Kazuhiko Togao, Shizuoka-ken, Japan

[73] Assignee: Yugengaisha Hotarl, Shizuoka-ken, Japan

[21] Appl. No.: 557,449

[22] Filed: Nov. 14, 1995

[30] Foreign Application Priority Data

Nov. 15, 1994 [JP] Japan ..... 6-014073 U

[51] Int. Cl.[6] ..... A63B 22/16

[52] U.S. Cl. ..... 482/146; 482/79

[58] Field of Search ..... 482/146, 79, 80; 434/258

[56] References Cited

U.S. PATENT DOCUMENTS

| | | | |
|---|---|---|---|
| 4,273,327 | 6/1981 | Nall et al. | 482/146 |
| 4,463,946 | 8/1984 | Wallace et al. | 434/258 |
| 5,092,586 | 3/1992 | Tuthill et al. | 482/146 |

FOREIGN PATENT DOCUMENTS

| | | |
|---|---|---|
| 59-93463 | 6/1984 | Japan . |
| 60-37321 | 3/1985 | Japan . |
| 64-52487 | 2/1989 | Japan . |

*Primary Examiner*—Lynne A. Reichard

*Attorney, Agent, or Firm*—Price, Gess & Ubell

[57] ABSTRACT

A flat board section 1 with a flat top surface 1*a*, which is formed as a flat surface, is made of a wooden board with sufficient thickness and strength for supporting a human body. A top surface 1*a* of flat board section 1 is octagonal and has an area which enables both feet or buttocks of a person to be placed thereon. A fulcrum section 2, which made of metal and has a hemispherical protrusion 2*a*, is provided at a central part of a bottom surface 1*b* of flat board section 1. Protrusion 2*a* is the part which always contacts with a floor surface or the ground when flat board section 1 is placed on the floor surface or the ground and is the part which serves as the center of winging of flat board section 1.

The invention presents a health equipment by which the lack of exercise can be resolved in a simple manner at home and regardless of athletic ability.

14 Claims, 3 Drawing Sheets

HEALTH EQUIPMENT

BACKGROUND OF THE INVENTION

1. Field of the Invention

The present invention concerns a health equipment by which a user can perform a suitable amount of exercise by attempting to stabilize his/her body upon placing himself/herself on the equipment.

2. Description of the Prior Art

People have become strongly conscious of health in recent years. A suitable amount of daily exercise can strengthen the legs and loins, promote circulation of the blood and prevent various disorders, such as internal disorders and stiff shoulders. However, in the present times when transportation means have advanced through urbanization and facilities of exercise that can cope with the aging of society are increasingly lacking, a lack of exercise has become a major obstacle to a person's health.

Various training equipment have been developed as means for resolving such lack of exercise and public or private facilities for sports equipped with such equipment have been established. There are thus many people who attempt to resolve their lack of exercise through the use of such facilities for sports.

Themes Intended to be Solved by the Invention

However, most of the training equipment has been developed for the improvement of the athletic abilities of athletes, etc. and cannot be said to be suitable for persons without much athletic ability, for persons who do not require such hard exercise, and for persons who must abstain from hard exercise.

Furthermore, although it is most desirable for ordinary persons to be able to perform soft exercises daily and continuously, facilities for sports, etc. require some kind of fee and, in cases where the facilities for sports, etc. is far away from the home, it becomes difficult to go there regularly. Furthermore, exercises with training equipment tend to become monotonous and it is difficult to keep up the interest in such exercises.

SUMMARY OF THE INVENTION

Objects of the Invention

The invention is proposed to solve the above-mentioned problems. It is a primary object of the invention to provide health equipment by which the lack of exercise can be resolved easily at home regardless of the level of athletic ability.

It is the second object of the invention to provide health equipment which is inexpensive and yet can withstand continuous daily use.

It is the third object of the invention to provide health equipment which is comfortable to use.

It is the fourth object of the invention to provide health equipment which can maintain the interest of the user.

Features and advantages of the Invention

The above-mentioned objects are achieved, by providing a flat board section with a top surface thereof being formed as a flat surface for supporting a body of a user; and a fulcrum section which protrudes from a central part of a bottom surface of said flat board section and swingably supports said flat board section with respect to the ground or a floor surface.

The user places the flat board section on a floor or the ground with its bottom side down and stands on the top surface of the flat board section with both feet. In this condition, the user will use his/her sense of balance and the muscles of the loins and legs in an attempt to balance him/herself so that the flat board section will remain balanced with respect to the ground or the floor surface. The flat board section then wings around a part of the fulcrum section and consequently, the user will perform exercise in a natural manner.

Said flat board section and said fulcrum section is made of a different material from each other.

This arrangement presents a product that is durable for the continuous daily use and yet pleasant to the touch. That is, for example, the flat board section, which is to be directly in contact with a body of a user, may be made of wood or resin that is soft for skin and the fulcrum section, to which the body weight is supported, may be made of a metal of high strength.

The top surface of said flat board section is covered with a elastic buffer material.

The part which is to be directly in contact with a body of a user is provided with suitable softness.

The top surface of said flat board section is covered with a elastic buffer material.

This arrangement presents a product that is durable for continuous daily use and yet pleasant to the touch. This arrangement also results in that the part which is to be directly in contact with a body of a user is provided with suitable softness.

A plurality of detection means, which are provided at a periphery of the bottom surface of said flat board section are used, for detecting contact with the ground or a floor surface; and an output means, which is connected to said detection means, for notifying the user of the contact of the bottom surface of said flat board section with the ground or the floor surface.

Contact of the bottom surface with the ground or the floor surface is detected by a detection means provided at that part of the bottom surface in contact with the ground or the floor surface and this, is notified to the user by the output device.

DETAILED DESCRIPTION

Preferred Embodiment (1) Arrangement of the embodiment

Figure 1:
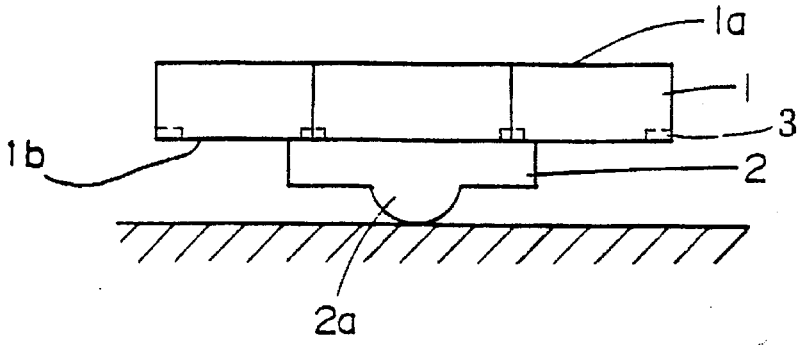
FIG. 1 is a front view showing health equipment which is one embodiment of the invention.
Figure 2:
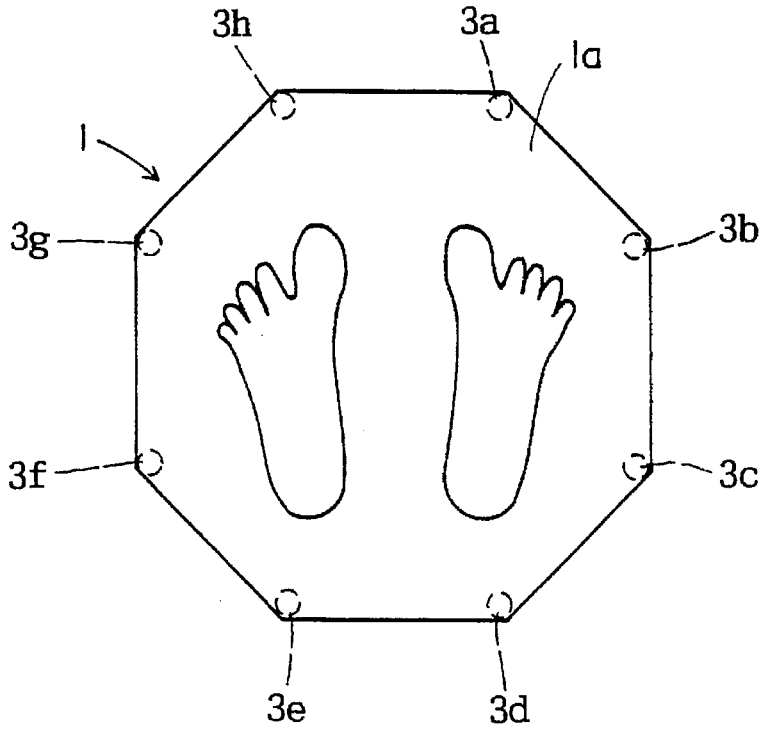
FIG. 2 is a plane view of the health equipment embodiment of FIG. 1.

As shown in FIG. 1, a flat board section 1 with a top surface 1*a*, which is formed as a flat surface, is made of a wooden board with sufficient thickness and strength for supporting a human body. As shown in FIG. 2, the top surface 1*a* of this flat board section 1 is octagonal and has an area which enables both feet or buttocks of a person to be placed thereon. At the central part of the bottom surface 1*b* of such a flat board section 1 is provided a fulcrum section 2 having a hemispherical protrusion 2*a* made of metal. This protrusion 2*a* is always in contact with a floor surface or the ground when flat board section 1 is placed on the floor surface or the ground and is the part which serves as the center of winging of flat board section 1.

(2) Actions of the embodiment

Figure 3:
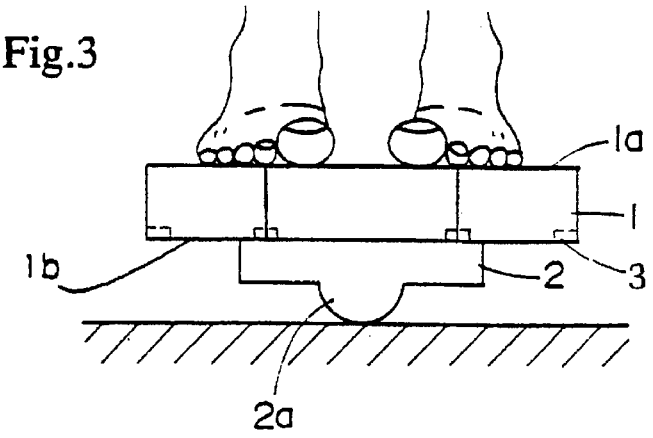
FIG. 3 is a front view showing the condition in which a user is balanced while being on the health equipment embodiment of FIG. 1.
Figure 4:
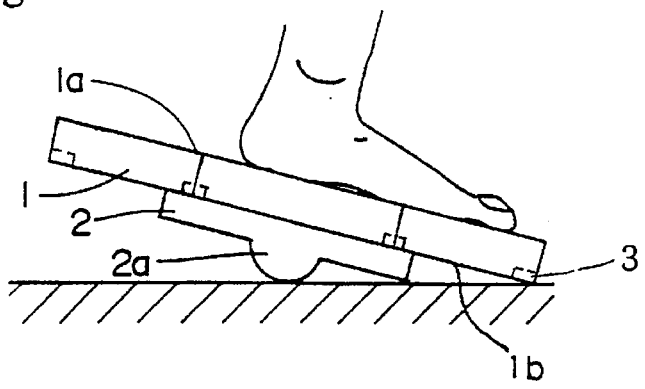
FIG. 4 is a side view showing a condition in which a user tilts towards the front while on the health equipment embodiment of FIG. 1.
Figure 5:
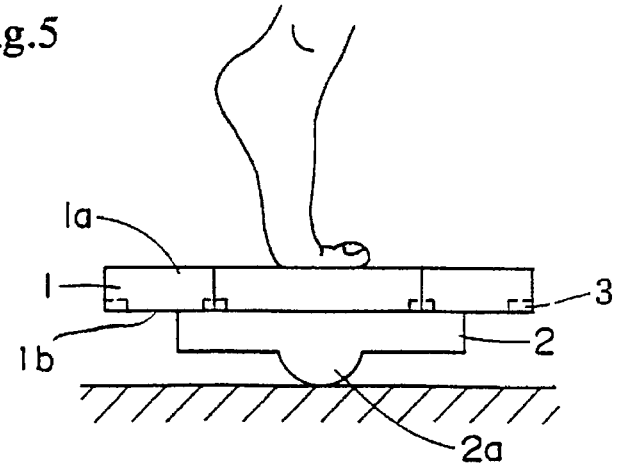
FIG. 5 is a side view showing a condition in which the user uses the health equipment embodiment of FIG. 1 while tiptoeing.

The actions of the present embodiment having the above arrangement are as follows. That is, when flat board section 1 is placed on the ground or a floor surface with its bottom surface 1*b* down, protrusion 2*a* will be in contact with the ground or the floor surface. As shown in FIG. 3, the user then stands on top surface 1*a* of flat board section 1 by placing both feet thereon. Then, as shown in FIG. 4, flat board section 1 will tilt in some direction to the front, back, left or right and a part thereof will be in contact with the ground or the floor surface. From this condition, the user will change his/her center of gravity without moving the feet placed on flat board section 1 so as to maintain the balance with respect to the ground or the floor surface as shown in FIG. 3. Since flat board section 1 extends above and about protrusion 2*a* at this time as shown in FIG. 4, the user will use his/her sense of balance and the muscles of the legs and loins in an attempt to balance and avoid falling off due to the tilting of flat board section 1. Thus in this process, the user can perform exercises in a natural manner. Furthermore, as shown in FIG. 5, when the user has become good in balancing him/herself in the above manner, he/she may attempt to balance him/herself with tiptoeing, which is more difficult and requires a more advanced sense of balance.

If the user does not have much athletic ability, it may be difficult for him/her to stand on flat board section 1 with his/her feet. In such a case, the equipment is used by placing the buttocks on flat board section 1 and balancing to strengthen the sense of balance and the muscles of the loins. Flat board section 1 may also be placed on the ground or floor surface with protrusion 2*a* facing upward to be used to massage the arch of the feet and other pressure points of the body.

(3) Effects of the preferred embodiment

The effects of the present embodiment described above are as follows. That is, since exercise can be performed in a natural manner simply by placing oneself and attempting to balance oneself on the flat board section 1 placed on the ground or floor, the lack of exercise can be resolved easily at home and regardless of athletic ability. This is particularly effective for persons for whom hard exercise is not suitable and is optimal for the prevention of injuries, etc. due to illness and accidents since the legs and loins and the sense of balance, which are important to the health of a human, can be trained and nurtured without taking the trouble of going to a facility for sports, etc.

As found in publications from the Ministry of Education, etc. officially announced in recent newspapers and magazines, the athletic ability of children in their childhood and boyhood is declining. The present embodiment, which is easy for such young children to use, is useful for improving the athletic ability, in particular for training the sense of balance of the young children.

Since flat board section 1 is made of wood, it is not uncomfortable even when a person's feet are placed directly thereon and since the fulcrum section is made of metal, adequate strength and durability are provided to support the entire weight of a human body. An equipment which can withstand continuous daily use can thus be arranged from inexpensive materials. In particular the flat board section 1 is suitable for placing human feet since its top surface is flat.

Furthermore, the use of the equipment by placing the buttocks on flat board section 1 is effective for aged persons who have difficulty balancing with standing and since this can be done even with watching television, etc., exercise may be performed safely and conveniently without much care. Since protrusion 2*a* may also be used as a massaging device, a more comprehensive health management is enabled with just one device.

(4) Other preferred embodiments

The invention is not limited to the above embodiment and the material, form, size, etc. of the members thereof can be changed as suited.

For example, flat board section 1 and fulcrum section 2 may be made of wood, metal, or resin and can be arranged from hollow members provided that such members have adequate strength. Furthermore, flat board section 1 and fulcrum section 2 may be made of the same material and as a single body. Such an arrangement will enable mass production in a factory and the presentation of less expensive products.

Figure 7:
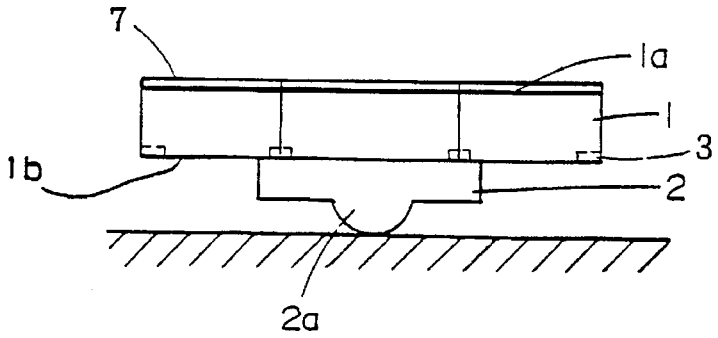
FIG. 7 is a schematic front view of the health equipment with detection means and cushioning material.

The shape of flat board section 1 may be circular, elliptical, polygonal, or any other shape as long as top surface 1*a* is flat. In particular, flat board section 1 can be made safer by providing a foot-shaped depression on the top surface thereof to prevent slipping as seen in FIG. 2. As shown in FIG. 7, an arrangement can be made wherein the top surface of flat board section 1 is covered with a cushioning material 7 such as a sponge and a cover, etc. for covering such sponge. Since the part in which the feet come in direct contact is thus made soft in such an arrangement, the equipment can be made more comfortable to use. This arrangement is also safe since the possibility for injury by hitting oneself with a hard part is also reduced.

Figure 6:
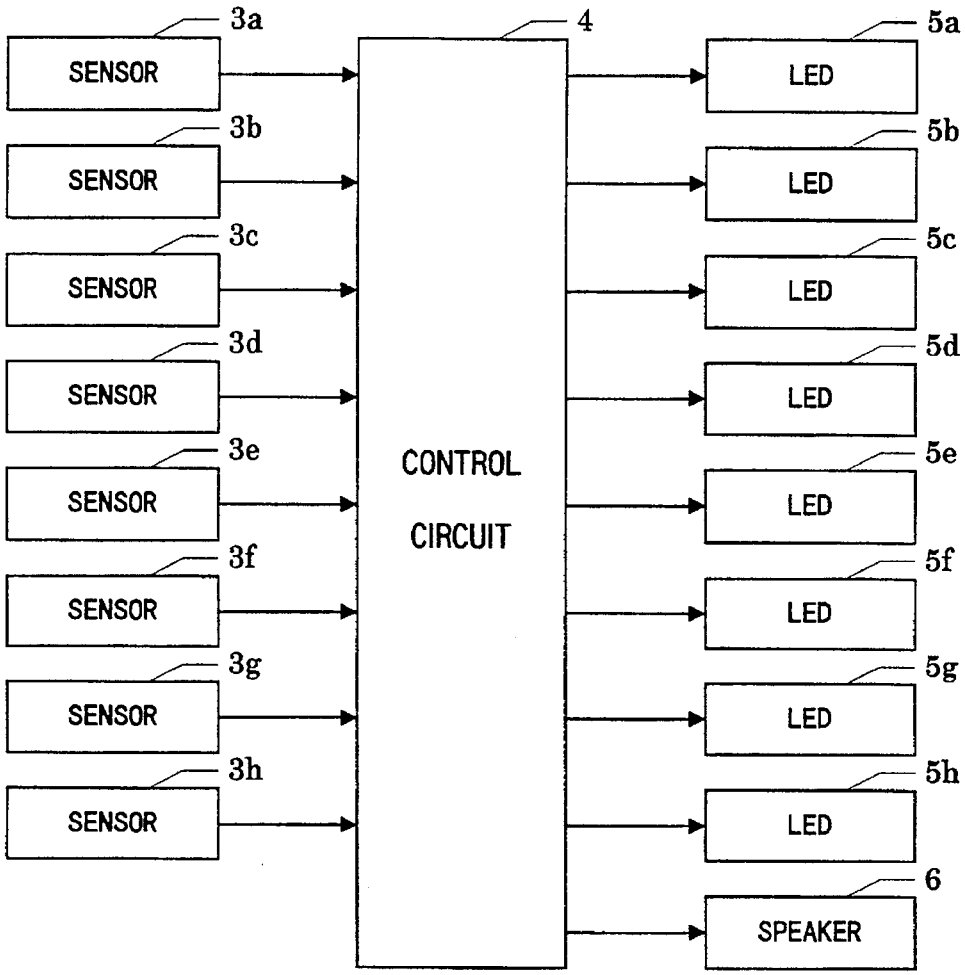
FIG. 6 is a schematic diagram of a detection means circuit.

As an alternative embodiment in FIGS. 6 and 7, an arrangement can be made wherein a plurality of sensors 3*a*–3*h* (detection means) are provided at the periphery of bottom surface 2*a* of flat board section 1 and these sensors can be connected via a control circuit 4 to light emitting members 5*a*–5*h*, such as a light emitting diode, or a sound emitting member 6, such as a buzzer or speaker (output means), so that different types of light or sound are emitted in correspondence with the direction to which the flat board section 1 tilts and comes into contact with the ground or the floor. With such an arrangement, the user will attempt to balance him/herself so that light or sound will not be emitted and since light or sound is emitted when he/she fails to balance, the equipment can be used for games to be played by several persons and can thus be made more interesting to the user.

Effect of the Invention

As described above, by the present invention, an excellent health equipment, by which the lack of exercise can be resolved simply at home and regardless of athletic ability, is presented through a simple arrangement in which a protruding fulcrum section is provided at the central part of the bottom surface of a flat board section with a top surface that is formed as a flat surface.

The invention also provides excellent health equipment, that is inexpensive and can yet withstand continuous daily use, through a simple arrangement wherein each of the flat board section and the fulcrum section is made of a different material from each other.

The invention also presents health equipment that is comfortable to use through a simple arrangement wherein the top surface of the flat board section is covered with a elastic buffer material.

The invention also presents a health equipment that can sustain the interest of the user through a simple arrangement wherein detection means for detecting the tilt of the flat board section and output means for indicating contact with the floor are provided.

What is claimed is:

1. A health equipment comprising:

a flat board section with a top surface thereof being formed as a flat surface for supporting a body of a user;

a fulcrum section which protrudes from a central part of a bottom surface of said flat board section and swingably supports said flat board section with respect to the ground or a floor surface;

a plurality of detection means, which are fixed on a periphery of the bottom surface of said flat board section, for detecting contact of the bottom surface of said flat board section with the ground or a floor surface and generating a detection signal when it detects such contact; and an output means, which is connected to said detection means, for receiving said detection signal from said detection means and notifying the user of the contact of the bottom surface of said flat board section with the ground or the floor surface.

2. A health equipment as claimed in claim 1, wherein each of said flat board section and said fulcrum section is made of a different material each other.

3. A health equipment as claimed in claim 1, wherein the top surface of said flat board section is covered with an elastic sponge material.

4. A health equipment as claimed in claim 1, wherein each of said flat board section and said fulcrum section is made of a different material, and wherein the top surface of said flat board section is covered with a elastic buffer material.

5. An exercise apparatus comprising:

a flat polygonal support member having a plurality of comers defining vertices relative to peripheral sides of the support member, the vertices being positioned equally about a center of the support member;

a fulcrum member connected to a central portion of a bottom surface of the support member to contact a support surface and to permit equal pivotal contact by any one or more vertices of the support member when a user is positioned on the support member;

a plurality of detection means provided about the periphery of the bottom surface for detecting contact with the support surface; and an output means, which is connected to the detection means, for notifying the user of contact with the support surface.

6. The exercise apparatus of claim 5 wherein an upper surface of the support member includes a pair of foot-shaped depressions for receiving the user's feet to prevent slipping.

7. The exercise apparatus of claim 5 wherein an upper surface of the support member is covered with a cushioning material to provide a soft resilient contact surface for the user.

8. The exercise apparatus of claim 5 wherein the output means provides an audible sound signal to the user.

9. The exercise apparatus of claim 8 wherein the output means provides a different type of sound notification to the user in correspondence with a direction of tilt when the detection means detects the contact with the support surface.

10. The exercise apparatus of claim 9 wherein the support member has an octagonal peripheral configuration.

11. An exercise apparatus comprising:

a flat polygonal support member having a plurality of comers defining vertices relative to peripheral sides of the support member, the vertices being positioned equally about a center of the support member;

a soft cushioning material overlaying a top surface of the support member for contacting feet of a user;

a fulcrum member having a hemispherical contact surface connected to a central portion of a bottom surface of the support member to contact a support surface and to enable movement of the support member equally in all directions of possible tilt about the fulcrum member whereby any one or more vertices of the support member can contact the support surface;

a plurality of detection means provided about the periphery of the bottom surface for detecting contact with the support surface; and output means connected to the detection means for providing an output sound, the output sound being different depending upon a direction of tilt when the detection means detects the contact with the support surface.

12. The exercise apparatus of claim 11 wherein the support member has an octagonal peripheral configuration.

13. The exercise apparatus of claim 12 wherein the output means includes a light emitting member.

14. The exercise apparatus of claim 11 wherein the hemispherical contact surface is of a size and configuration to knead an arch of a foot of a user for massaging purposes.

* * * * *